US009578725B2

(12) United States Patent
Menghi et al.

(10) Patent No.: US 9,578,725 B2
(45) Date of Patent: Feb. 21, 2017

(54) STARTING DEVICE FOR DISCHARGE LAMPS

(71) Applicant: EASYLUMEN S.R.L., Rimini (RN) (IT)

(72) Inventors: Alberto Menghi, Santarcangelo di Romagna (IT); Demos Fuochi, Imola (IT)

(73) Assignee: EASYLUMEN S.R.L., Rimini (RN) (IT)

( * ) Notice: Subject to any disclaimer, the term of this patent is extended or adjusted under 35 U.S.C. 154(b) by 0 days.

(21) Appl. No.: 15/022,744

(22) PCT Filed: Sep. 26, 2014

(86) PCT No.: PCT/IT2014/000257
§ 371 (c)(1),
(2) Date: Mar. 17, 2016

(87) PCT Pub. No.: WO2015/044973
PCT Pub. Date: Apr. 2, 2015

(65) Prior Publication Data

US 2016/0345417 A1 Nov. 24, 2016

(30) Foreign Application Priority Data

Sep. 27, 2013 (IT) ..... RN2013A0039

(51) Int. Cl.

| | |
|---|---|
| ***H05B 41/16*** | (2006.01) |
| ***H05B 41/10*** | (2006.01) |
| ***H05B 41/18*** | (2006.01) |
| ***H01F 27/245*** | (2006.01) |

(52) U.S. Cl.
CPC ..... *H05B 41/10* (2013.01); *H01F 27/245* (2013.01); *H05B 41/18* (2013.01)

(58) Field of Classification Search
CPC ..... H05B 41/295; H05B 41/232; H05B 41/28; H05B 41/042; H05B 41/18
USPC ..... 315/281, DIG. 2, 5, 248
See application file for complete search history.

(56) References Cited

U.S. PATENT DOCUMENTS

| | | | | |
|---|---|---|---|---|
| 4,275,337 | A | 6/1981 | Knoble et al. | |
| 5,497,052 | A | 3/1996 | Buckley, II | |
| 6,100,653 | A * | 8/2000 | Lovell | H01J 61/56 315/248 |
| 6,366,023 | B1 | 4/2002 | Tran et al. | |
| 6,404,142 | B2 * | 6/2002 | Miyata | H05B 41/042 315/274 |

FOREIGN PATENT DOCUMENTS

| | | | |
|---|---|---|---|
| EP | 1063870 | A1 | 12/2000 |
| GB | 777626 | A | 6/1957 |

OTHER PUBLICATIONS

International Search Report and Written Opinion dated Feb. 5, 2015 from counterpart PCT App No. PCT/IT2014/000257.

* cited by examiner

*Primary Examiner* — Minh D A
(74) *Attorney, Agent, or Firm* — Shuttleworth & Ingersoll, PLC; Timothy J. Klima

(57) ABSTRACT

A starting device for discharge lamps including an ignitor and a ferromagnetic ballast, composed of a toroidal core, equipped with at least an air gap, and an electric coil wound around the toroidal core.

10 Claims, 4 Drawing Sheets

STARTING DEVICE FOR DISCHARGE LAMPS

This application is the National Phase of International Application PCT/IT2014/000257 filed Sep. 26, 2014 which designated the U.S. and that International Application was published under PCT Article 21(2) in English.

This application claims priority to Italian Application No. RN2013A000039 filed Sep. 27, 2013, which application is incorporated by reference herein.

TECHNICAL FIELD

This invention relates to a starting device for discharge lamps.

In starting devices for discharge lamps, according to known technical criteria which have been widespread for some time now, at least a "starter" ignitor and a ballast must be present which, acting together, cause an overvoltage in the electrodes, contained in the lamp tube together with a gas. That overvoltage triggers an electric discharge which ionises the gas present in the tube, producing the emission of light radiation.

After starting, the lamp switches to normal operation, in which the ballast takes on the function of stabiliser for the electric current drawn, so that the light radiation emitted is uniform and stable.

BACKGROUND ART

Said schematic operation can basically be traced back to traditional luminaires, which use a ballast composed of a core of small ferromagnetic plates in a pack, on which a metal conductor coil is wound, powered by alternating current mainly supplied by public electric networks. Since the ballast load is highly inductive, it is usually necessary to add, in the lamp power circuit, a power factor correction capacitor.

However, as described in document EP 1063870, the use is also known of traditional transformers, with primary and secondary windings, intended to increase the saturation current of the secondary winding, when the discharge lamp starting module is miniaturised, as is the case, for example in motor vehicle headlights.

Although such technology is still widespread, both for the many systems still operating, but also for new systems in particular for lighting streets and outdoor structures, various alternative solutions have been adopted, aiming to overcome the defects and limits of ferromagnetic ballasts. Such limits basically consist of some noisiness during operation caused by lamellar pack vibrations, the poor tolerance of voltage oscillations on the electric networks at various times of day, accentuated thermal dispersion, with consequent reduction of component lifetime, and above all low overall energy efficiency obtainable with such ballasts.

Therefore, alternative electronic devices are currently spreading, such as the self-oscillating ballast, which needs neither the ignitor (or starter), since it can use a trigger voltage produced inside it, nor the power factor correction capacitor, since the power factor is high enough. Moreover, the overall efficiency of the luminaire is considerably higher than that obtained using ferromagnetic ballasts.

Other devices use an electronic control circuit for varying the lamp power supply voltage and frequency, making said parameters optimal for the various phases which come one after another, such as filament heating, initial discharge, stable operation or variations in the brightness of the lamp.

An example is described in document U.S. Pat. No. 4,275,337, in which an electronic ignitor is also able to very quickly re-start a discharge lamp which has been switched off.

In general, the above-mentioned various types of electronic devices for powering discharge lamps, although working very well, are not good at withstanding prolonged exposure to weather, particularly at the high temperatures which occur in systems for lighting streets or outdoor areas, with energy efficiency and technical performance which rapidly deteriorate over time, even necessitating their early substitution.

Another disadvantage which must be considered is the high cost of such electronic devices. Said particular features mean that even today traditional ferromagnetic ballasts are still widely used.

DISCLOSURE OF THE INVENTION

The aim of this invention is, therefore, to eliminate the above-mentioned limitations and disadvantages.

The invention, as described in the claims, achieves that aim by using a ballast which has a core made of annealed ferromagnetic material, with a toroidal shape, in which a suitably sized air gap is present.

The main advantage of this invention is basically the fact that the overall energy efficiency of the luminaire reaches a high value, therefore with low energy costs for operation.

Another advantage is due to the fact that the ballast does not suffer from reduced efficiency and technical performance during operation outdoors and in a hot environment, nor is it affected by the voltage oscillations present on the electricity networks, therefore guaranteeing a longer lifetime than that of electronic power devices and devices comprising traditional ferromagnetic ballasts.

A further advantage is the fact that the high level of operating reliability and long lifetime of the invention guarantee significant savings due to the reduced maintenance required by systems in which it is installed.

BRIEF DESCRIPTION OF THE DRAWINGS

Further advantages and features of the invention are more apparent in the detailed description which follows, with reference to the accompanying drawings, which illustrate an example embodiment of it without limiting the scope of the invention, in which.

DETAILED DESCRIPTION OF PREFERRED EMBODIMENTS OF THE INVENTION

Figure 1:
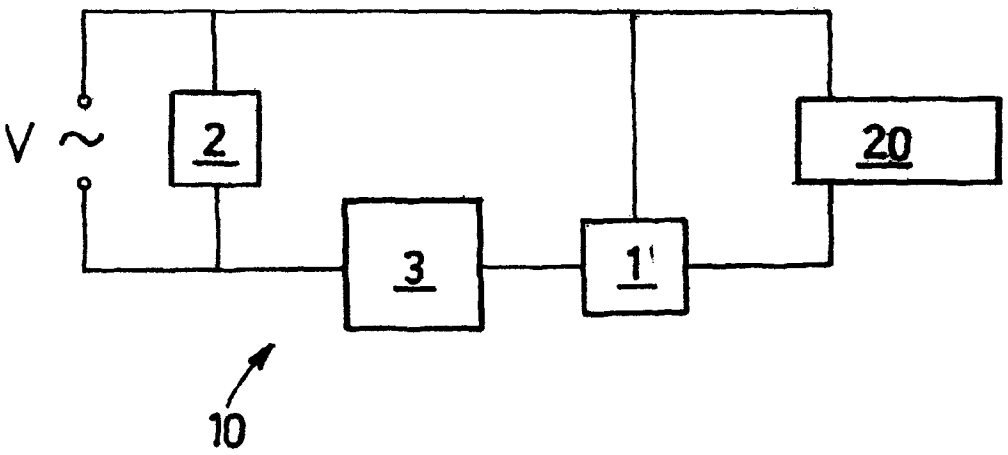
FIG. 1 is a block diagram of the invention.

A starting device for discharge lamps comprises at least an ignitor 1 and a ferromagnetic ballast 3. The ferromagnetic ballast 3 is composed of at least a toroidal core 5, equipped with at least an air gap 5*a*, and an electric coil 4, wound around the toroidal core 5. That shape of the ferromagnetic ballast 3 allows the obtainment of lasting high energy efficiency, resulting in corresponding improved efficiency of the device 10 and the lamp 20 with which it is associated.

In a preferred embodiment of the invention, schematically illustrated in FIG. 1, the starting device 10 comprises a power factor correction capacitor 2 for the current drawn by the lamp 20 and by the ferromagnetic ballast 5.

Figure 2:
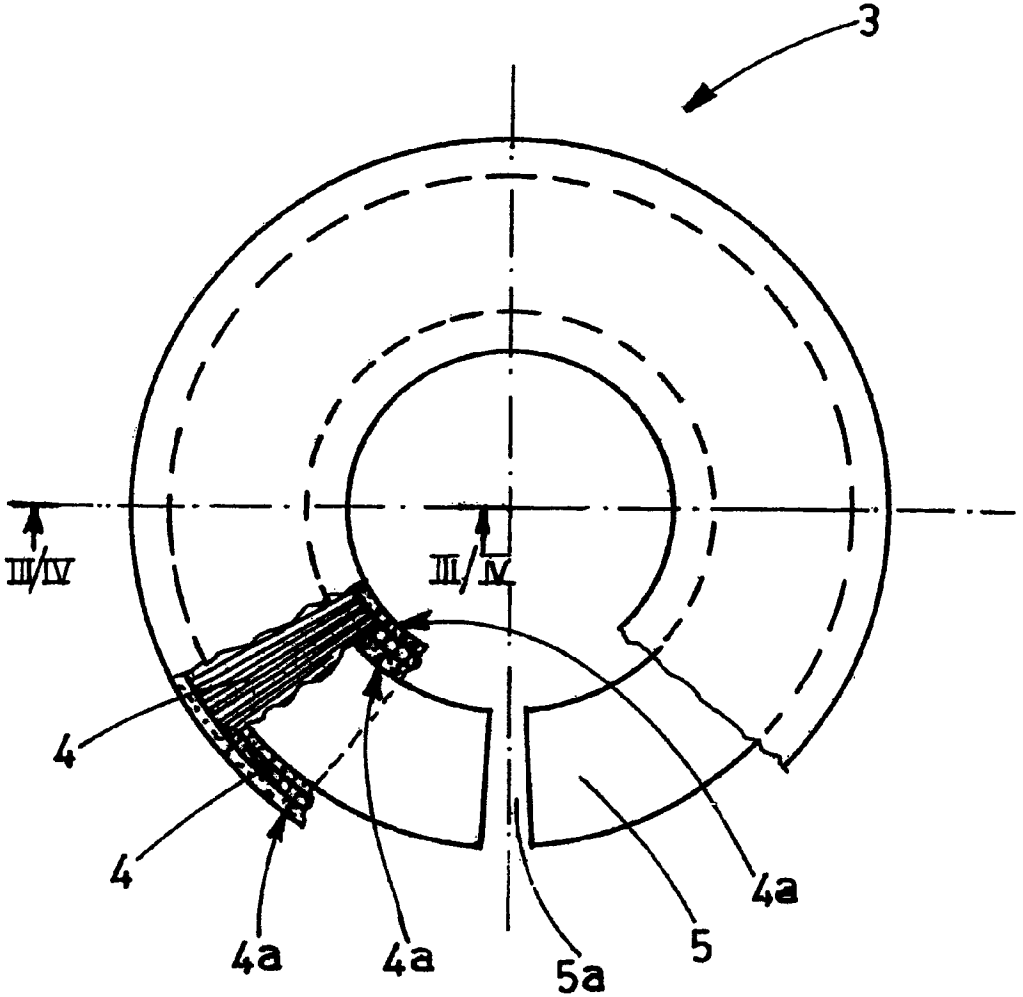
FIG. 2 is a top view of a component of the invention, with some parts cut away to better illustrate others.
Figure 4:
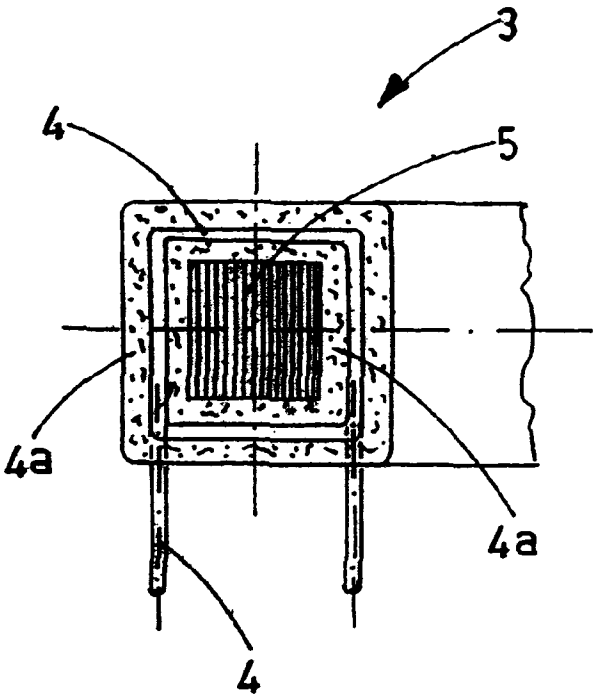
FIGS. 3 and 4 are radial cross-sections of two possible alternative embodiments of the same component as in FIG. 2.
Figure 3:
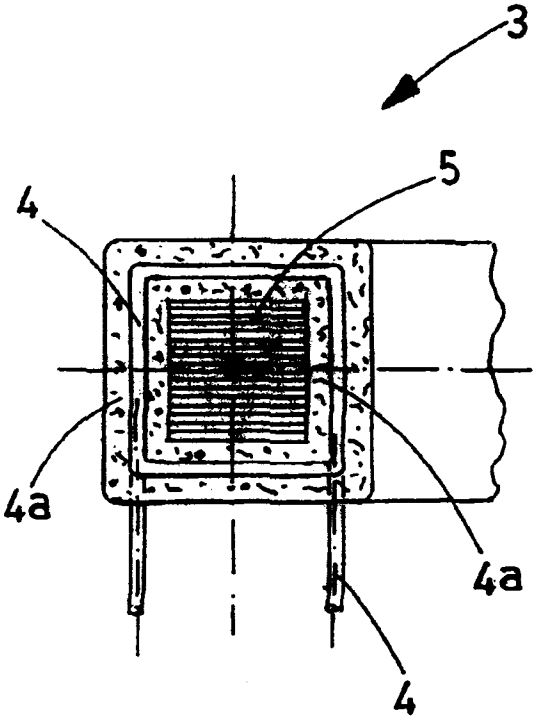

The toroidal core 5 may be made in various ways: it may be composed of one or more small plates made of ferromagnetic material wound over themselves in a spiral, as shown in FIG. 4, of small plates of ferromagnetic material in a pack, as shown in FIGS. 2 and 3, or even solid ferromagnetic material. Annealing of the ferromagnetic material after the air gap 5*a* has been created in any case guarantees improvement of the magnetic properties of the core, reducing losses caused by magnetic hysteresis.

The electric coil 4 is made of copper. In a possible alternative embodiment, the electric coil 4 is made of aluminium or another conducting material, so as to make the ferromagnetic ballast 3 as a whole less heavy.

The electric coil 4, as illustrated in FIGS. 2, 3 and 4, may be coupled to the toroidal core 5 by means of a resin layer 4*a* which gives the set of parts greater compactness, guaranteeing that the ferromagnetic ballast 3 will be less noisy due to vibrations, better insulated and more able to withstand corrosion due to weather.

Figure 5:
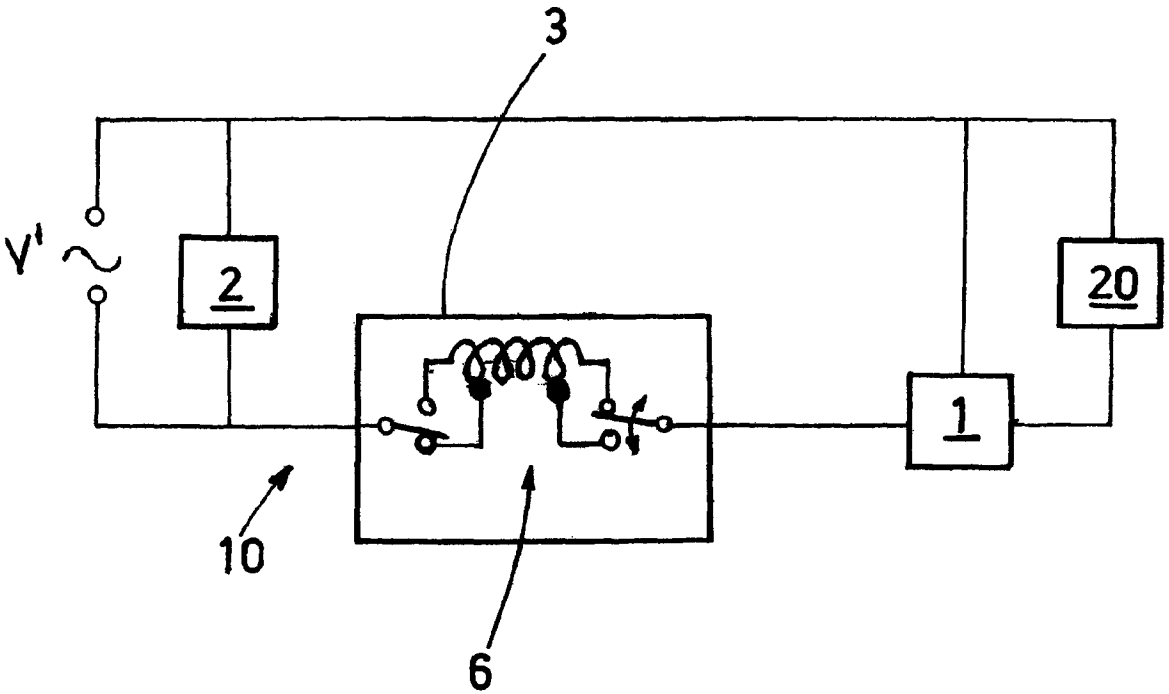
FIG. 5 is a schematic illustration of an alternative embodiment of the invention.

The device 10 may also involve the use of at least one intermediate electrical connection 6, which allows the device 10 to operate using inductance values of the electric coil 4 of the ferromagnetic ballast 3 which are lower than the nominal value, as is schematically illustrated in FIG. 5. This figure shows how the intermediate electrical connection 6 allows the ferromagnetic ballast 3 to be used for ballasts having an input voltage V' different to the input voltage V of 220 Volts found in most cases. The intermediate electrical connection 6 also allows different output voltages to be obtained, so as to regulate the luminous flux depending on the energy saving.

The invention claimed is:

1. A starting device for discharge lamps, comprising at least an ignitor and a ferromagnetic ballast, wherein the ferromagnetic ballast is composed of at least a toroidal core, equipped with at least an air gap, and one electric coil, wound around the toroidal core.

2. The starting device according to claim 1, wherein it comprises a capacitor, designed for power factor correction of the current drawn by the lamp and by the ferromagnetic ballast.

3. The starting device according to claim 1, wherein the toroidal core is composed of at least a small plate wound in a spiral over itself, made of ferromagnetic material.

4. The starting device according to claim 1, wherein the toroidal core is composed of small plates in a pack, made of ferromagnetic material.

5. The starting device according to claim 1, wherein the toroidal core is made of solid ferromagnetic material.

6. The starting device according to claim 1, wherein the electric coil made of copper.

7. The starting device according to claim 1, wherein the electric coil is made of aluminium.

8. The starting device according to claim 1, wherein the electric coil is associated with the toroidal core by means of a resin layer.

9. The starting device according to claim 1, wherein it comprises at least an intermediate electrical connection, able to reduce the inductance of the electric coil comprised in the ferromagnetic ballast.

10. A method for making a starting device, comprising at least an ignitor and a ferromagnetic ballast, composed of at least a toroidal core, equipped with at least an air gap, and an electric coil wound around the toroidal core, wherein it comprises at least a step of annealing the toroidal core after the air gap has been created.

* * * * *